US005621853A

United States Patent [19]

Gardner

[11] Patent Number: 5,621,853

[45] Date of Patent: Apr. 15, 1997

[54] BURST EXCITED LINEAR PREDICTION

[76] Inventor: William R. Gardner, 1072 Hayes Ave., San Diego, Calif. 92103

[21] Appl. No.: 529,374

[22] Filed: Sep. 18, 1995

Related U.S. Application Data

[63] Continuation of Ser. No. 189,814, Feb. 1, 1994, abandoned.

[51] Int. Cl.[6] ..... G10L 3/02; G10L 9/00

[52] U.S. Cl. ..... 395/2.28; 395/2.1; 395/2.71

[58] Field of Search ..... 371/5.1, 37.4, 371/39.1; 370/50, 95.1, 109; 381/35–41, 46–47, 51; 395/2, 2.1, 2.25, 2.28, 2.35, 2.67, 2.71

[56] References Cited

U.S. PATENT DOCUMENTS

| | | | |
|---|---|---|---|
| 4,191,853 | 3/1980 | Piesinger | 395/2.67 |
| 5,121,391 | 6/1992 | Paneth et al. | 370/95.1 |
| 5,138,661 | 8/1992 | Zinser et al. | 381/35 |
| 5,305,332 | 4/1994 | Ozawa | 395/2.28 |
| 5,341,456 | 8/1994 | DeJaco | 395/2.23 |
| 5,353,374 | 10/1994 | Wilson et al. | 395/2.35 |

FOREIGN PATENT DOCUMENTS

| | | | |
|---|---|---|---|
| 0532225 | 3/1993 | European Pat. Off. | G10L 5/00 |
| 0573398 | 12/1993 | European Pat. Off. | G10L 9/14 |
| 9315503 | 8/1993 | WIPO | G10L 9/14 |

OTHER PUBLICATIONS

Suwa et al, "transmitter diversity characteristics in microcontroller tdma/tdd mobile radio;" PIMRC '92. The third IEEE International symposium on personal, indoor and mobile radio communications, pp. 545–549, 19–21 Oct. 1992.

Gerlach, "a probabilistic framework for optimum speech extrapolation in digital mobile radio;" ICASSP–93, pp. 419–422 vol. 2, 27–30 Apr. 1990.

Gardner et al, "Non–casual linear prediction of voiced speech;" Conference record of the twenty–sixth asilomar conference on signals, systems and computers pp. 1100–1104 vol. 2, 26–28 Oct. 1992.

LeBlanc et al, "Performance of a low complexity celp speech coder under mobile channel fading conditions"; 39th IEEE vehicular technology conference, pp. 647–651 vol. 2, 1–3 May 1989.

Tzeng et al, "Error protection for low rate speech transmission over a mobile satellite channel"; Globecom '90, pp. 1810–1814 vol. 3, 2–5 Dec. 1990.

*Primary Examiner*—David K. Moore
*Assistant Examiner*—Tariq Rafiq Hafiz

[57] ABSTRACT

A novel and improved apparatus for encoding a signal which is bursty in nature. In a code excited linear prediction algorithm, short term redundancies and long term redundancies are removed from digitally sampled speech, and the residual signal which is bursty in nature must be encoded. The residual signal is encoded using three parameters a burst shape index corresponding to a burst shape in a codebook of burst shapes, a burst gain, and a burst location. Together the three parameters specify a waveform to match the residual signal. Further disclosed is a closed loop exhaustive search method by which to find the best match to the residual waveform and a partially open loop method wherein the burst location is determined by an open loop analysis of the residual waveform, and the burst shape and gain parameters are determined in a closed loop fashion. Also disclosed are methods by which a burst vector codebook may be provided which may result in reduced computational complexity in the search algorithms including a recursive burst codebook and a codebook structured in such a way that members of the codebook are linear combinations of other members of the codebook.

12 Claims, 3 Drawing Sheets

BURST EXCITED LINEAR PREDICTION

This is a continuation of application Ser. No. 08/189,814, filed Feb. 1, 1994, now abandoned.

BACKGROUND OF THE INVENTION

I. Field of the Invention

The present invention relates to speech processing. More particularly, the present invention relates to a novel and improved method and apparatus for performing linear predictive speech coding using burst excitation vectors.

II. Description of the Related Art

Transmission of voice by digital techniques has become widespread, particularly in long distance and digital radio telephone applications. This in turn has created interest in determining methods which minimize the amount of information sent over the transmission channel while maintaining high quality in the reconstructed speech. If speech is transmitted by simply sampling and digitizing, a data rate on the order of 64 kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. The model is constantly changes to accurately model the time varying speech signal. Thus the speech is divided into blocks of time, or analysis frames, during which the parameters are calculated. The parameters are then updated for each new frame.

Of the various classes of speech coders, the Code Excited Linear Predictive Coding (CELP), Stochastic Coding, or Vector Excited Speech Coding coders are of one class. An example of a coding algorithm of this particular class is described in the paper "A 4.8 kbps Code Excited Linear Predictive Coder" by Thomas E. Tremain et al., *Proceedings of the Mobile Satellite Confers,* 1988. Similarly, examples of other vocoders of this type are detailed in patent application Ser. No. 08/004,484, filed Jan. 14, 1993, now U.S. Pat. No. 5,414,796 entitled "Variable Rate Vocoder" and assigned to the assignee of the present invention, and U.S. Pat. No. 4,797,925, entitled "Method For Coding Speech At Low Bit Rates". The material in the aforementioned patent application and the aforementioned U.S. patent is incorporated by reference herein.

The function of the vocoder is to compress the digitized speech signal into a low bit rate signal by removing all of the natural redundancies inherent in speech. Speech typically has short term redundancies due primarily to the filtering operation of the vocal tract, and long term redundancies due to the excitation of the vocal tract by the vocal cords. In a CELP coder, these operations are modeled by two filters, a short term formant (LPC) filter and a long term pitch filter. Once these redundancies are removed, the resulting residual signal can be modeled as white Gaussian noise, which also must be encoded.

The process of determining the coding parameters for a given frame of speech is as follows. First, the parameters of the LPC filter are determined by finding the filter coefficients which remove the short term redundancy, due to the vocal tract filtering, in the speech. Second, the parameters of the pitch filter are determined by finding the filter coefficients which remove the long term redundancy, due to the vocal cords, in the speech. Finally, an excitation signal, which is input to the pitch and LPC filters at the decoder, is chosen by driving the pitch and LPC filters with a number of random excitation waveforms in a codebook, and selecting the particular excitation waveform which causes the output of the two filters to be the closest approximation to the original speech. Thus the transmitted parameters relate to three items (1) the LPC filter, (2) the pitch filter, and (3) the codebook excitation.

One shortcoming of CELP coders is the use of random excitation vectors. The use of the random excitation vectors fails to take into account the burst like nature of the ideal excitation waveform, which remains after the short-term and long-term redundancies have been removed from the speech signal. Unstructured random vectors are not particularly well suited for encoding the burst like residual excitation signal, and result in an inefficient method for coding the residual excitation signal. Thus, there is a need for an improved method for coding the target signals which incorporates the burst like nature of the residual excitation signal, resulting in higher quality speech at tower encoded data rates.

SUMMARY OF THE INVENTION

The present invention is a novel and improved method and apparatus for encoding the residual excitation signal which takes into account the burst like nature of such signal. The present invention encodes the bursts of large energy in the excitation signal with a burst excitation vector, rather than encoding the entire excitation signal with a random excitation vector. The candidate burst waveforms are characterized by a burst shape, a burst gain and burst location. This set of three burst parameters determines an excitation waveform, which is used to drive the LPC and pitch filters so that the output of the filter pair is a close approximation to the target speech signal.

Further described herein is a method and apparatus for providing more than one set of burst parameters, which produces an improved approximation to the target speech signal. In the exemplary description, a set of burst parameters corresponding to one burst is found which results in a minimal difference between the filtered burst waveform and the target speech waveform. The waveform produced by filtering this burst by the LPC and pitch filter pair is then subtracted from the target signal, and a subsequent search for a second set of burst parameters is conducted using the new, updated target signal. This iterative procedure is repeated as often as desired to match the target waveform precisely.

A first method and apparatus is provided which performs the burst excitation search in a closed loop fashion. That is, when the target signal is known, an exhaustive search of all burst shapes, burst gains and burst locations is conducted, with the optimum combination determined by selecting the shape, gain, and location which result in the best match between the filtered burst excitation and the target signal. Alternatively, the number of computations may be reduced by conducting a suboptimal search over only a subset of any of the three parameters.

Also, a partially open loop method is described wherein the number of parameters to be searched is greatly reduced by analyzing the residual excitation signal, identifying the locations of greatest energy, and using those locations as the locations of the excitation bursts. In a multiple burst partially open loop implementation, a single location is identified as described above, a burst gain and shape are identified for the given burst location, the filtered burst signal is subtracted from the target signal, and the residual excitation signal corresponding to the remaining target signal is again analyzed to find a subsequent burst location. In another multiple burst partially open loop implementation, a plurality of burst locations is first identified by analyzing the residual excitation waveform, and the burst gains and shapes are then determined for the burst locations as described in the first method.

Lastly, a series of methods for reducing the computational complexity and storage requirements of the search algorithm is disclosed. The first method entails providing a recursive burst set wherein each succeeding burst shape may be derived for its predecessor by removing one or more elements from the beginning of the previous shape sequence and adding one or more elements to the end of the previous shape sequence. Another method entails providing a burst set wherein a succeeding burst shape is formed using a linear combination of previous bursts.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein:

FIG. 1*a* is uncoded speech, FIG. 1*b* is speech with short term redundancy removed and FIG. 1*c* is speech with short term and long term speech redundancies removed, also known as the ideal residual excitation waveform;

DETAILED DESCRIPTION OF THE PREFERRED EMBODIMENTS

Figure 1A:
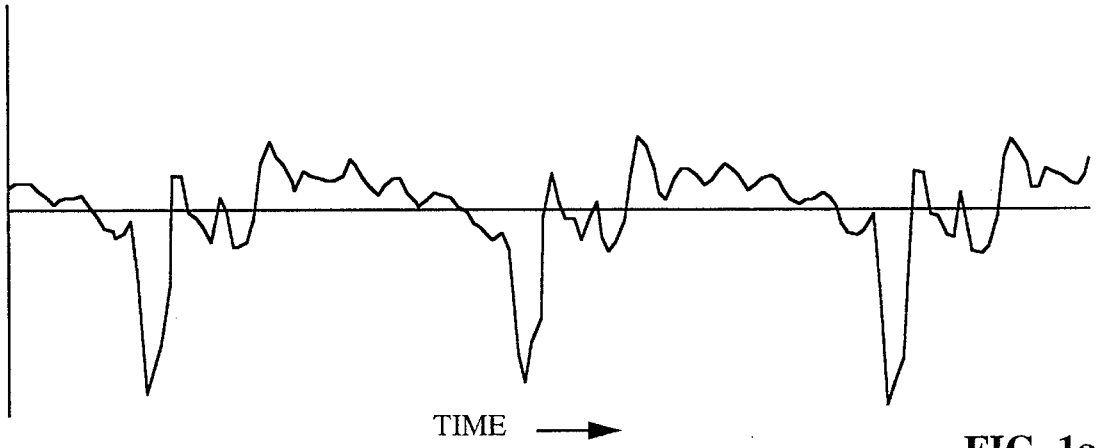
FIGS. 1*a–c* is an illustration of a set of three waveforms.
Figure 1B:
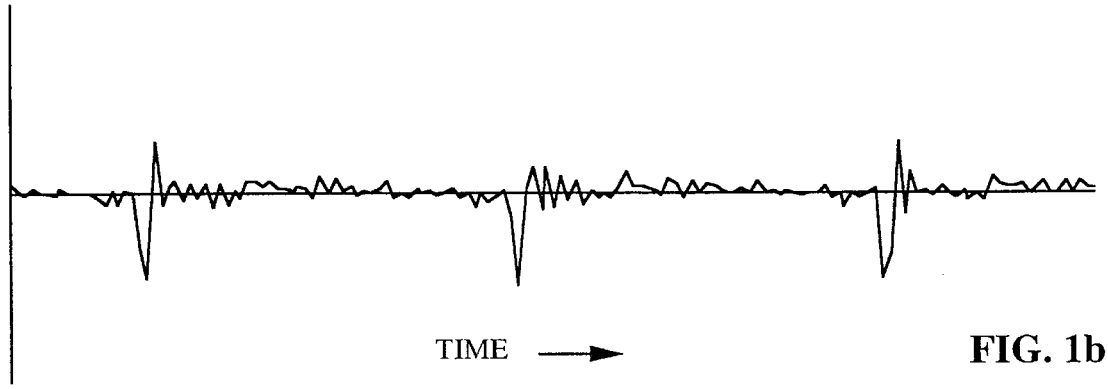
Figure 1C:
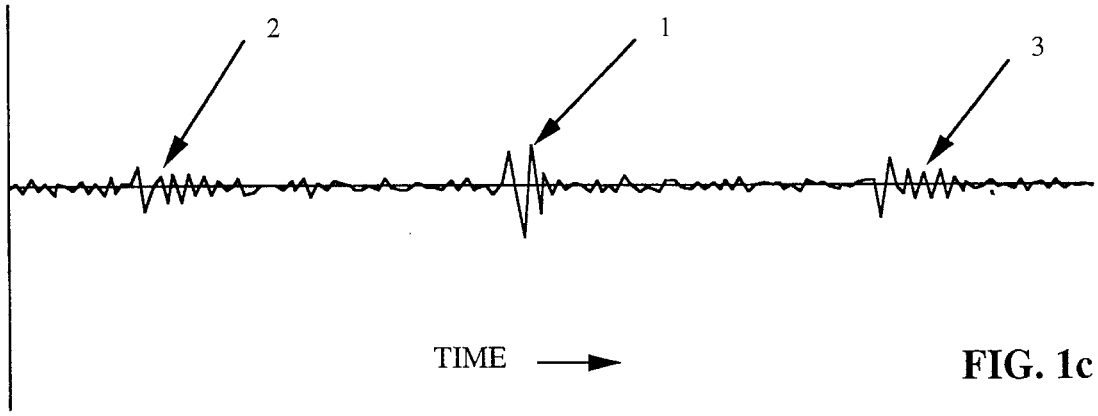

FIGS. 1*a–c* illustrate three waveforms with time on the horizontal axis and amplitude on the vertical axis. FIG. 1*a* illustrates a typical example of an uncoded speech signal waveform. FIG. 1*b* illustrates the same speech signal as FIG. 1*a* with the short term redundancy removed by means of a formant (LPC) prediction filter. The short term redundancy in speech is typically removed by computing a set of autocorrelation coefficients for a speech frame and determining from the autocorrelation coefficients a set of linear prediction coding (LPC) coefficients by techniques that are well known in the art. The LPC coefficients may be obtained by the autocorrelation method using Durbin's recursion as discussed in *Digital Processing of Speech Signals,* Rabiner & Schafer, Prentice-Hall, Inc., 1978. Methods for determining the tap values of the LPC filters are also described in the aforementioned patent application and patent. These LPC coefficients determine a set of tap values for the formant (LPC) filter.

FIG. 1*c* illustrates the same speech samples as FIG. 1*a*, but with both short term and long term temporal redundancies removed. The short term redundancies are removed as described above and then the residual speech is the filtered by a pitch prediction filter to remove long term temporal redundancies in the speech, the implementation of which is well known in the art. The long term redundancies are removed by comparing the current speech frame with a history of previously coded speech. The coder identifies a set of samples from the previous coded excitation signal which, when filtered by the LPC filter, is a best match to the current speech signal. This set of samples is specified by a pitch lag, which specifies the number of samples to look backward in time to find the excitation signal which produces the best match, and a pitch gain, which is a multiplicative factor to apply to the set of samples. Implementations of pitch filtering are described in the aforementioned patent application and patent.

A typical example of the resulting waveform, referred to as the residual excitation waveform, is illustrated in FIG. 1*c*. The large energy components in the residual excitation waveform typically occur in bursts, which are marked by arrows 1, 2 and 3 in FIG. 1*c*. The modeling of this target waveform has been accomplished in previous work by seeking to match the entire residual excitation waveform to a random vector in a vector codebook. In the present invention, the coder seeks to match the residual excitation waveform with a plurality of burst vectors, thus more closely approximating the large energy segments in the residual excitation waveform.

Figure 2:
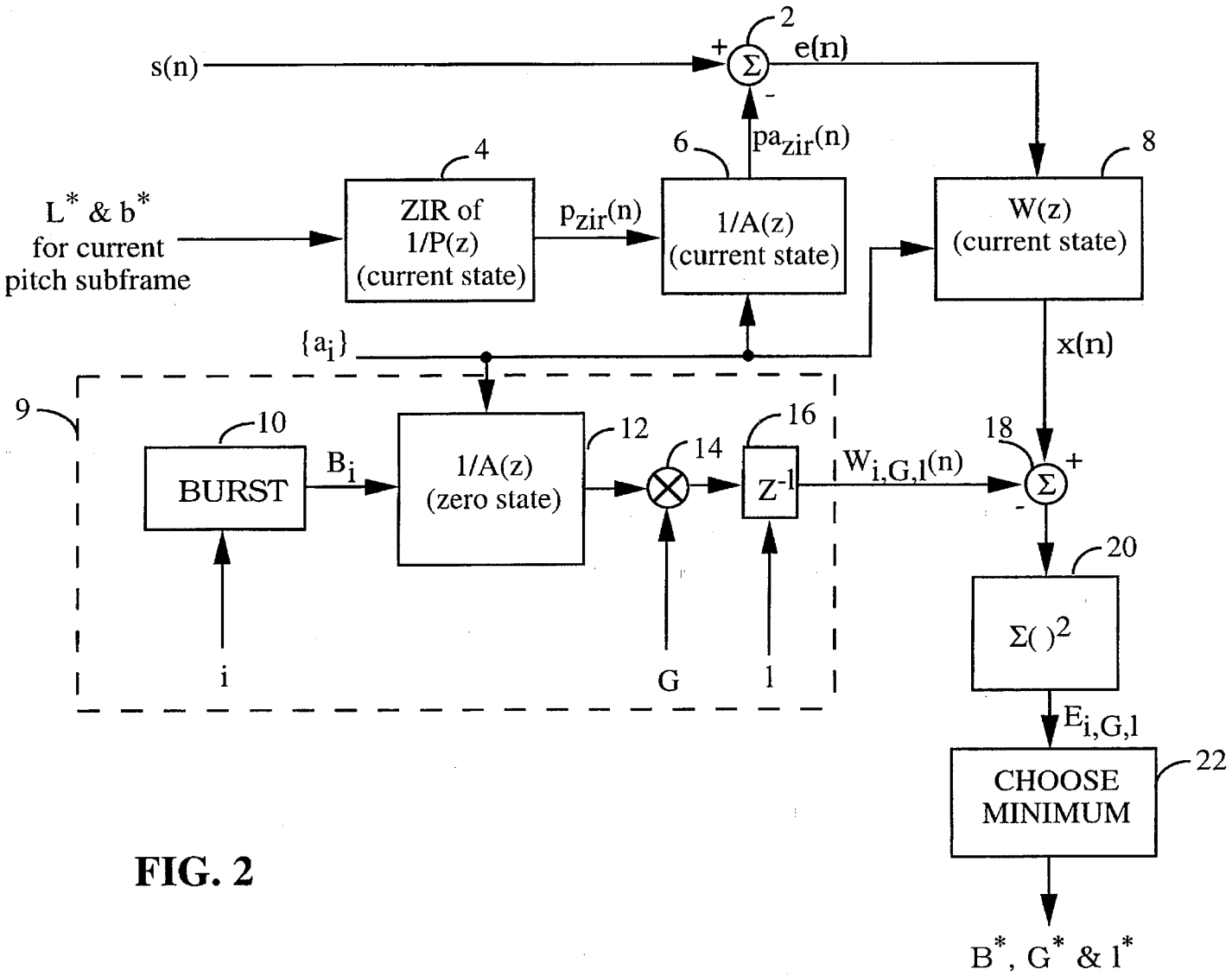
FIG. 2 is a block diagram illustrating the closed loop search mechanism.

FIG. 2 illustrates an exemplary implementation of the present invention. In the exemplary embodiment illustrated in FIG. 2, the search for the optimum burst shape (B), burst gain (G) and burst location (l) is determined in a closed loop form.

The input speech frame, s(n), is provided to the summing input of summing element 2. In the exemplary embodiment each speech frame consists of forty speech samples. The optimum pitch lag L* and pitch gain b* determined previously in a pitch search operation is provided to pitch synthesis filter 4. The output of pitch synthesis filter 4 provided in accordance with optimum pitch lag L* and pitch gain b* is provided to LPC filter 6.

Previously computed LPC coefficients, $a_i$, are provided to formant (LPC) synthesis filter 6, perceptual weighting filter 8, and memoryless formant (LPC) synthesis filter 12. The tap values of filters 6, 8 and 12 are determined in accordance with these LPC coefficients. The output of formant (LPC) synthesis filter 6 is provided to the subtracting input of summing element 2. The error signal computed in summing element 2 is provided to perceptual weighting filter 8. Perceptual weighting filter 8 filters the signal and provides its output, the target signal, x(n), to the summing input of summing element 18.

Element 9 exhaustively provides candidate waveforms to the subtracting input of summing element 18. Each candidate waveform is identified by a burst shape index value, i, a burst gain, G, and a burst location, l. In the exemplary implementation each candidate waveform consists of forty samples. Burst element 10 is provided with a burst shape index value i, in response to which burst element 10 provides a burst vector, $B_i$, of a predetermined number of samples. In the exemplary embodiment each of the burst vectors are nine samples long. Each burst vector is provided to memoryless formant (LPC) synthesis filter 12 which filters the input burst vector in accordance with the LPC coefficients. The output of memoryless formant synthesis filter 12 is provided to one input of multiplier 14.

The second input to multiplier 14 is the burst gain values G. In the exemplary embodiment, there are sixteen different gain values. The gain values can be of a predetermined set of values or can be determined adaptively from characteristics of past and present input speech frames. For each burst vector, all gain values G are exhaustively tested to determine the optimal gain value, or the optimal unquantized gain value for a particular value of l and i can be determined using methods known in the art, with the chosen value of G quantized to the nearest of the sixteen different gain values after the search. The product from multiplier 14 is provided to variable delay element 16.

Variable delay element 16 also receives a burst location value, l and positions the burst vector within the candidate waveform frame in accordance with the value of l. If a candidate waveform frame consists of L samples, then the maximum number of locations to be tested is:

$$\text{no. of possible locations}=L-\text{burst_length}+1 \quad (1)$$

where burst_length is the duration of the burst in samples (burst_length=9 in the exemplary embodiment). In an alternative embodiment, a subset of the number of possible burst locations can be chosen to reduce the resulting data rate. For example, it is possible only to allow a burst to begin at every other sample location. Testing a subset of burst locations will reduce complexity, but will result in a suboptimal coding which in some cases may reduce the resulting speech quality.

The candidate waveform, $w_{i,G,l}(n)$ is provided to the subtracting input of summing element 18. The difference between the target waveform and the candidate waveform is provided to energy computation element 20. Energy computation element 20 sums the squares of the members of the weighted error vector in accordance with equation 2 below:

$$E_{i,G,l}=\sum_{n=0}^{L-1}[x(n)-w_{i,G,l}(n)]^2 \quad (2)$$

The computed energy value for every candidate waveform is provided to minimization element 22. Minimization element 22 compares each minimum energy value found thus far to the current energy value. If the energy value provided to minimization element 22 is less than the current minimum, the current energy value is stored in minimization element 22 and the current burst shape, burst gain, and burst position values are also stored. After all allowable burst shapes, burst positions, and burst locations have been searched, the best match candidate B*, G* and l* are provided by minimization element 22.

For a better match to the target vector, a candidate waveform may consist of more than one burst. In this case of multiple burst candidate waveforms, a first search is conducted and a the best match waveform is identified. The best match waveform is then subtracted from the target signal and additional searches are conducted. This process may be repeated for as many bursts as desired. In some cases it may be desirable to restrict the burst location search so that a previously selected burst location cannot be selected more than once. It has been noticed in noisy speech that burst like noise has a different audible character than random noise. By restricting the bursts to be spaced apart from one another, the resulting excitation signal is closer to random noise and may be perceived as more natural in some circumstances.

Figure 3:
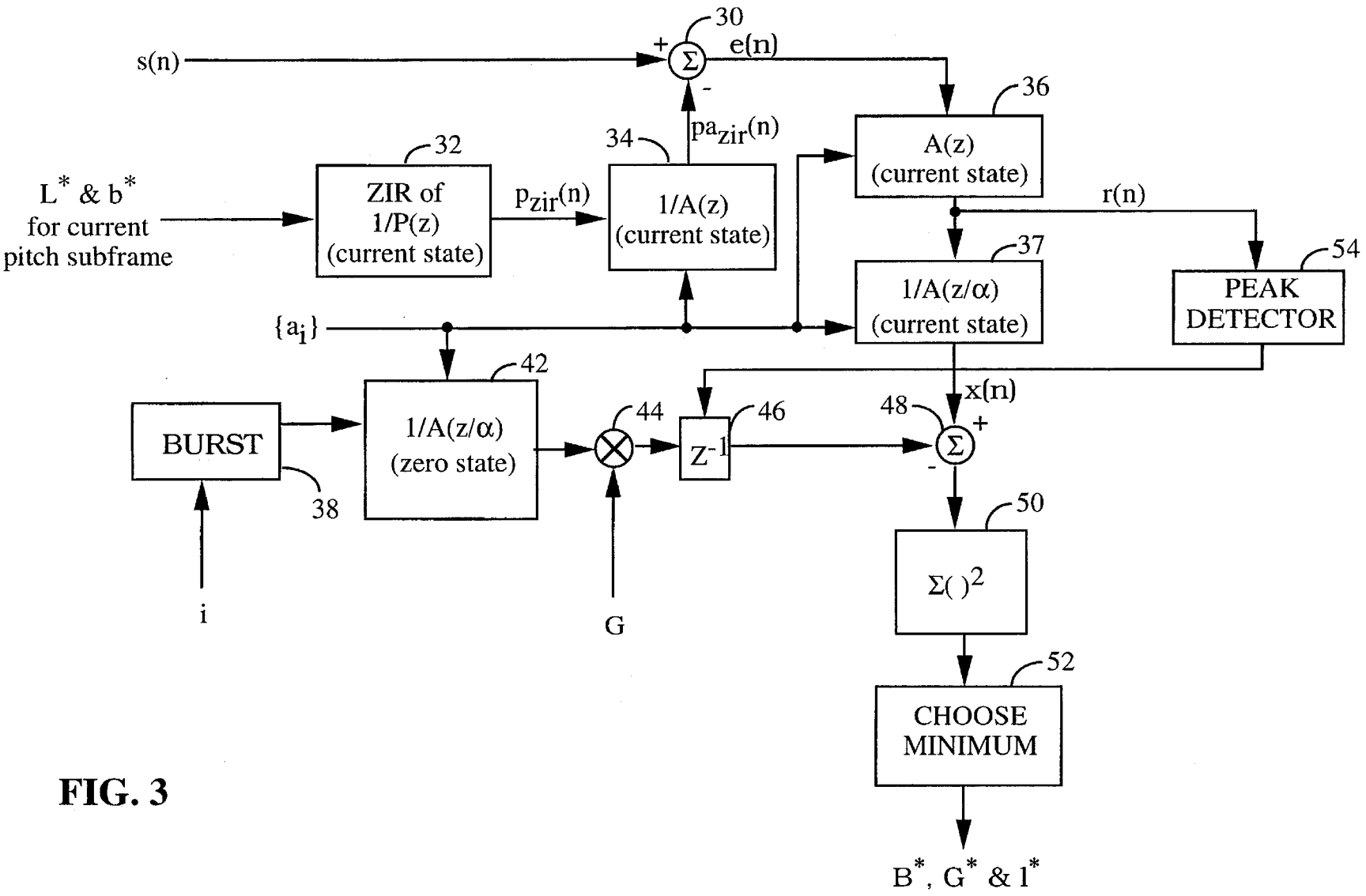
FIG. 3 is a block diagram illustrating the partially open loop search mechanism.

In order to reduce the computational complexity of the search operation, a second partially open loop search may be conducted. The apparatus by which the partially open loop search, is conducted is illustrated in FIG. 3. By this method, the locations of the burst are determined using an open loop technique, and subsequently the burst shapes and gains are determined in the closed loop fashion described previously.

As in the operation of the closed loop search illustrated in FIG. 2, the input speech frame, s(n), is provided to the summing input of summing element 30. The optimum pitch lag L* and pitch gain b* determined previously in a pitch search operation are provided to pitch synthesis filter 32. The output of pitch synthesis filter 32 provided in accordance with optimum pitch lag L* and pitch gain b* is provided to format (LPC) synthesis filter 34.

Previously computed LPC coefficients, $a_i$, are provided to formant (LPC) synthesis filter 34, all-zeroes perceptual weighting filter 36, all-poles perceptual weighting filter 37 and memoryless weighted LPC filter 42. In the exemplary embodiment, the perceptual weighting filter described in relation to FIG. 2 can be decomposed into two separate filters; an all-zeroes filter 36 and an all-pole filter 37. The tap values of filters 32, 36, 37 and 42 are determined in accordance with the LPC coefficients.

The output of formant (LPC) synthesis filter 34 is provided to the subtracting input of summing element 30. The error signal computed in summing element 30 is provided to all-zeroes perceptual weighting filter 36. All-zeroes perceptual weighting filter 36 filters the signal and provides its output, r(n), to the input of all-poles perceptual weighting filter 37. All-poles perceptual weighting filter 37 outputs the target signal x(n) to the summing input of summing element 48.

The output of all-zeroes perceptual weighting filter 36, r(n), is also provided to peak detector 54, which analyzes the signal and identifies the location of the largest energy burst in the signal. The equation by which the burst location l is found is:

$$l=\arg\max_i \sum_{i=l}^{l+\text{burst_length}} r^2(i) \quad (3)$$

By performing this portion of the search in this manner, the total number of parameters which must be searched in the closed loop is decreased by 1/l.

The search for the burst shape, i, and burst gain, G, is then conducted in a closed fashion as described earlier. Burst element 38 is provided with a burst index value i, in response to which burst element 38 provides burst vector, $B_i$. $B_i$ is provided to memoryless weighted LPC filter 42 which filter the input burst vector in accordance with the LPC coefficients. The output of memoryless weighted LPC filter 42 is provided to one input of multiplier 44.

The second input to multiplier 44 is the burst gain values G. The output of multiplier 44 is provided to burst location element 46 which, in accordance with the burst location value l, positions the burst within the candidate frame. The candidate waveforms are subtracted from the target signal in summing element 48. The differences are then provided to energy computation element 50 which computes the energy of the error signal as described previously herein. The computed energy values are provided to minimization element 52, which as described above detects the minimum error energy and provides the identification parameters B*, G* and l.

A multiple burst partially open-loop searches can be done by identifying a first best match waveform, subtracting the unfiltered best match waveform from the output of all-zeroes perceptual weighting filter 36, r(n), and determining the location of the next burst by finding the location in the new, updated r(n) which has the greatest energy, as described above. After determining the location of the subsequent burst, the filtered first best match waveform is subtracted from the target vector, x(n), and the minimization search conducted on the resulting waveform. This process may be repeated as many times as desired. Again it may be desirable to restrict the burst locations to be different from one another for the reasons enumerated earlier herein. One simple means of guaranteeing that the burst locations are different is by replacing r(n) with zeroes in the region into which a burst was subtracted before conducting a subsequent burst search.

It is further envisioned that the burst elements 10 and 38 may be optimized to reduce the computational complexity of the recursion computations that are necessary in the computation of the filter responses to filters 12 and 42. For example the burst values may be stored as recursive burst set wherein each subsequent burst shape may be derived from its predecessor by removing one or more elements from the beginning of the previous sequence and adding one or more elements to the end of the previous sequence. In alternative strategies, the bursts may be interrelated in other ways. For example, half of the bursts may be the sample inversions of other bursts, or bursts may be constructed using linear combinations of previous bursts. These techniques also reduce the memory required by burst elements 10 and 38 to store all of the candidate burst shapes.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. In a linear prediction coder in which short term redundancies and long term redundancies are removed from frames of digitized speech samples resulting in a residual waveform, within said linear prediction coder an apparatus for encoding said residual waveform using a burst shape of a dimension smaller than said residual waveform comprising:

candidate waveform generator means for selecting said burst shape, a burst gain and a burst location and for generating a candidate waveform of a first number of samples in accordance with said burst gain, said burst location and said burst shape wherein said burst shape is of a second number of samples less than said first number of samples and for outputting said candidate waveform; and comparison means for receiving said residual waveform and said candidate waveform and for comparing said candidate waveform to said residual waveform and outputting a comparison signal in accordance with said comparison.

2. The apparatus of claim 1 further comprising candidate waveform selection means for receiving said comparison signal for each candidate waveform and comparing said comparison signal to a current minimum value and storing a candidate waveform identification value when said comparison signal is less than said current minimum value and for selecting a best match candidate waveform in accordance with said waveform identification value.

3. The apparatus of claim 1 wherein candidate waveform generator means comprises:

burst codebook means for outputting said burst shape;

formant synthesis filter means for receiving said burst shape and filtering said burst shape in accordance with a predetermined filtering format;

burst gain multiplication means for receiving said filtered burst shape and a burst gain value and multiplying said filtered burst shape by said burst gain to a burst gain product and for outputting said burst gain product; and burst location means for receiving said burst gain product and a burst location and temporally positioning said burst gain product in a speech residual frame in accordance with said burst location value to generate said candidate waveform and for outputting said candidate waveform.

4. The apparatus of claim 1 further comprising peak detection means for receiving said residual waveform and detecting said burst location in said residual waveform in accordance with a predetermined burst location format.

5. In a linear prediction coder in which short term and long term redundancies are removed from frames of digitized speech samples resulting in a residual waveform, within said linear prediction coder a method for encoding said residual waveform using a burst shape of a dimension smaller than said residual waveform comprising the steps of:

generating a candidate waveform in accordance with said burst shape of a second number of samples wherein said second number of samples is less than said first number of samples, a burst gain and a burst location wherein said burst shapes are generated in accordance with a recursive burst shape format wherein a subsequent burst shape is derived from a previous burst shape by removing at least one bit from the end of said burst shape and appending at least one new bit to the front of said burst shape;

comparing said candidate waveform to said residual waveform; and generating a comparison signal in accordance with said comparison.

6. The apparatus of claim 1 wherein said burst shapes are generated in accordance with a recursive burst shape format wherein a subsequent burst shape is derived from a previous burst shape by removing at least one bit from the end of said burst shape and appending at least one new bit to the front of said burst shape.

7. In a linear prediction coder in which short term and long term redundancies are removed from frames of digitized speech samples resulting in a residual waveform, within said linear prediction coder a method for encoding said residual waveform of a first number of samples using a burst shape of a dimension smaller than said residual waveform comprising the steps of:

generating a candidate waveform in accordance with said burst shape wherein said burst shape is of a second number of samples wherein said second number of samples is less than said first number of samples, a burst gain and a burst location;

comparing said candidate waveform to said residual waveform; and generating a comparison signal in accordance with said comparison.

8. The method of claim 7 wherein the steps of claim 6 are repeated for a predetermined set of burst shapes, burst gains and burst locations and further comprising the step of selecting in accordance with said comparison signal for each candidate waveform a best match waveform.

9. The method of claim 7 wherein said step of generating a candidate waveform comprises the steps of:

filtering said burst shape in accordance with a predetermined formant filtering format;

multiplying said filtered burst shape by said burst gain to generate a burst gain product; and temporally positioning locating said burst gain product in accordance with said burst location value to generate said candidate waveform.

10. The method of claim 7 wherein said step of generating a candidate waveform comprises the steps of:

detecting from said residual waveform said burst location value;

filtering said burst shape in accordance with a predetermined formant filtering format;

multiplying said filtered burst shape by said burst gain to generate a burst gain product; and temporally positioning said burst gain product in accordance with said burst location value to generate said candidate waveform.

11. The method of claim 7 wherein said burst shapes are generated in accordance with a recursive burst shape format wherein a subsequent burst shape is derived from a previous burst shape by removing at least one bit from the end of said burst shape and appending at least one new bit to the front of said burst shape.

12. In a linear prediction coder in which short term redundancies and long term redundancies are removed from frames of digitized speech samples resulting in a residual waveform, within said linear prediction coder an apparatus for encoding said residual waveform using a burst shape of a dimension smaller than said residual waveform comprising:

candidate waveform generator means for selecting said burst shape, a burst gain and a burst location and for generating a candidate waveform in accordance with said burst shape, said burst gain and said burst location and for outputting said candidate waveform wherein said burst shapes are generated in accordance with a recursive burst shape format wherein a subsequent burst shape is derived from a previous burst shape by removing at least one bit from the end of said burst shape and appending at least one new bit to the front of said burst shape; and comparison means for receiving said residual waveform and said candidate waveform and for comparing said candidate waveform to said residual waveform and outputting a comparison signal in accordance with said comparison.

* * * * *